US005944593A

United States Patent [19]

Chiu et al.

[11] Patent Number: 5,944,593

[45] Date of Patent: Aug. 31, 1999

[54] RETAINER RING FOR POLISHING HEAD OF CHEMICAL-MECHANICAL POLISH MACHINES

[75] Inventors: Daniel Chiu, Hsinchu Hsien; C. C. Yang, Hsinchu; Peng-Yih Peng, Hsinchu Hsien; J. Y. Wu, Hsinchu; J. S. Lai, Kaohsiung Hsien, all of Taiwan

[73] Assignee: United Microelectronics Corp., Taiwan

[21] Appl. No.: 08/959,518

[22] Filed: Oct. 28, 1997

[30] Foreign Application Priority Data

Sep. 3, 1997 [TW] Taiwan ..... 86214921

[51] Int. Cl.[6] ..... B24B 21/18

[52] U.S. Cl. ..... 451/442; 451/288; 451/398

[58] Field of Search ..... 451/442, 288, 451/287, 41, 398, 60, 446

[56] References Cited

U.S. PATENT DOCUMENTS

| | | | |
|---|---|---|---|
| 5,597,346 | 1/1997 | Hempel, Jr. | 451/287 |
| 5,695,392 | 12/1997 | Kim | 451/288 |
| 5,749,771 | 5/1998 | Isobe | 451/41 |

*Primary Examiner*—David A. Scherbel
*Assistant Examiner*—Dung Van Nguyen
*Attorney, Agent, or Firm*—Finnegan, Henderson, Farabow, Garrett & Dunner, L.L.P.

[57] ABSTRACT

A retainer ring is provided for used on the polishing head of a CMP machine, which can allow the slurry being applied to the CMP process to be uniformly distributed over the surface of the wafer. The retainer ring is designed for use on a CMP machine of the type having a polishing table, a polishing pad, a polishing head for holding a semiconductor wafer retained in fixed position, and means for applying a mass of slurry to the wafer. The polishing head is of the type including an air-pressure means which can apply air pressure to a wafer loader used to hold the wafer in position. The retainer ring is formed with a plurality of straight grooves spaced at substantially equal intervals, each being radially inclined in such a manner so as to form an acute angle of attack against the slurry on the outside of said retainer ring when said retainer ring spins. Further, the retainer ring can be additionally formed with at least one circular groove intercrossing all of said straight grooves. The straight grooves can cause the slurry to be drawn into the inside of the retainer ring from all radial directions, thus allowing the slurry to be spread uniformly over the wafer.

6 Claims, 8 Drawing Sheets

Average : 7245.58Å Range : 2374.40Å Scan Direction : Horizontal

Standard : 366.32 Å(5.06 %) Center Position : (0.000,0.000) mm

Average : 6960.89Å Range : 687.33Å Scan Direction : Horizontal

Standard : 128.37 Å(1.84 %) Center Position : (0.000,0.000) mm

RETAINER RING FOR POLISHING HEAD OF CHEMICAL-MECHANICAL POLISH MACHINES

BACKGROUND OF THE INVENTION

1. Field of the Invention

This invention relates to semiconductor fabrication technologies, and more parcularly, to an improved structure for the retainer ring used on the polishing head of a chemical-mechanical polish (CMP) machine to retain a semiconductor wafer in position while performing the CMP process.

2. Description of Related Art

In semiconductor fabrications, the chemical-mechanical polish (CMP) technique is widely used for the global planarization of semiconductor wafers that are used for the fabrication of VLSI (very large-scale integration) and ULSI (ultra large-scale integration) integrated circuits.

FIGS. 1A and 1B are schematic diagrams showing a conventional CMP machine which includes a polishing table 10 on which a polishing pad 12 is layered, a polishing head 14 for holding a semiconductor wafer 16 in position, and a nozzle 18 for applying a mass of slurry to the semiconductor wafer 16 during the CMP process.

FIG. 1C shows a detailed inside structure of the polishing head 14. As shown, the polishing head 14 includes an air-pressure means 20 which can apply air pressure to a wafer loader 22 used to hold the wafer 16. In addition, a retainer ring 24 is mounted around the loader 22 and the wafer 16, which can retain the wafer 16 in fixed position during the CMP process. Moreover, a cushion pad (not shown) is placed between the wafer 16 and the loader 22.

FIGS. 2A–2B show a conventional structure for the retainer ring 24. Using the retainer ring structure of FIGS. 2A–2B, however, the slurry being spread therethrough into the polishing head 14 would be nonuniformly distributed over the surface of the wafer, thus causing the drawbacks of a large wafer-edge exclusion range, a low refuse removing rate, an inefficient use of the slurry, and a reduced life of use of the cushion pad. The resultant surface flatness of the wafer after undergoing a CMP process using the retainer ring of FIGS. 2A–2B is shown in FIG. 3. The graph of FIG. 3 shows the thickness of the wafer in relation to the various points of a straight line passing through the spinning center of the wafer. From the plot shown in FIG. 3, it can be seen that the flatness is not quite satisfactory. The standard deviation of the thickness data is about 5.06%.

SUMMARY OF THE INVENTION

It is therefore an objective of the present invention to provide a new retainer ring for used on the polishing head of a CMP machine, which can allow the slurry being applied to the CMP process to be more uniformly distributed over the surface of the wafer being polished by the polishing head of the CMP machine, thus solving the abovementioned problems ofthe drawbacks of a large wafer-edge exclusion range, a low refuse removing rate, an inefficient use of the slurry, and a reduced life of use of the cushion pad.

In accordance with the foregoing and other objectives of the present invention, a new retainer ring for used on the polishing head of a CMP machine is provided. The retainer ring is designed for use on a CMP machine of the type having a polishing table, a polishing pad layered on said polishing table, a polishing head for holding a semiconductor wafer retained in fixed position by said retainer ring, and means for applying a mass of slurry to the wafer. The polishing head is of the type including an air-pressure means which can apply air pressure to a wafer loader used to hold the wafer in position during the CMP process.

In accordance with a first preferred embodiment of the invention, the retainer ring is formed with a plurality of straight grooves spaced at substantially equal angular intervals around said retainer ring, each of said straight grooves being radially inclined in such a manner so as to form an acute angle of attack against the slurry on the outside of said retainer ring when said retainer ring spins.

In accordance with a second preferred embodiment of the invention, the retainer ring is formed with, in addition to the above-mentioned straight grooves, at least one circular groove between the inner side and outer side of the retainer ring intercrosssing all of the straight grooves.

The equally spaced manner of arrangement of the straight grooves can cause the slurry to be drawn into the inside of the retainer ring from all radial directions, thus allowing the slurry to be spread uniformly over the wafer held on the inside of the retainer ring. Further, the provision of the circular groove allows the slurry being drawn in through the straight grooves to be partly buffered by and flow into the circular groove, thus allowing those edge portions of the wafer that are proximate the inner ends of the straight grooves to receive a buffered flow of slurry.

BRIEF DESCRIPTION OF DRAWINGS

The invention can be more fully understood by reading the following detailed description of the preferred embodiments, with reference made to the accompanying drawings, wherein.

DETAILED DESCRIPTION OF PREFERRED EMBODIMENTS

Figure 1A:
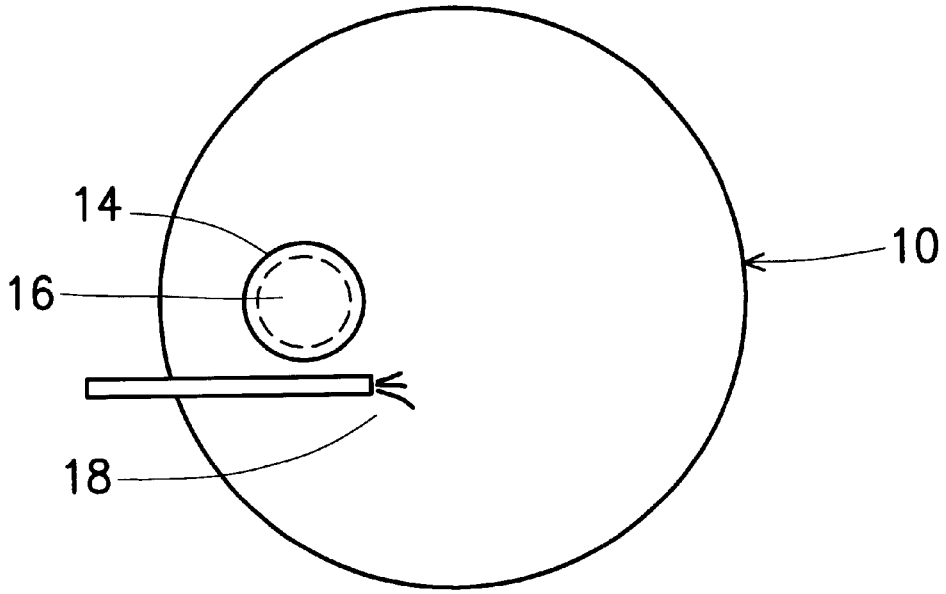
FIG. 1A (PRIOR ART)
FIG. 1A is a schematic top view of a CMP machine for performing a CMP process on a semiconductor wafer.
Figure 1B:
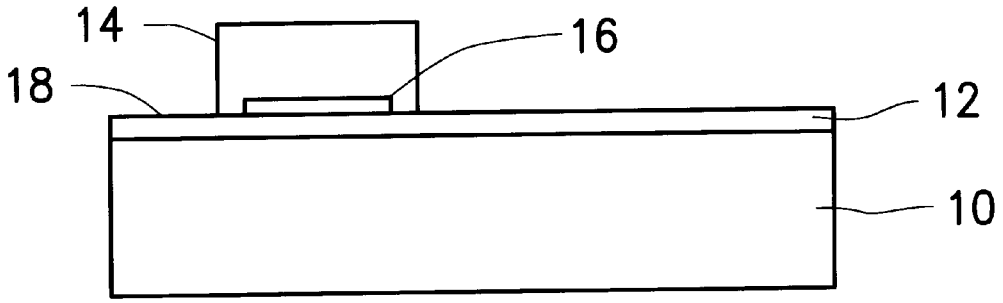
FIG. 1B (PRIOR ART)
FIG. 1B is a schematic sectional view of the CMP machine of FIG. 1A.
Figure 1C:
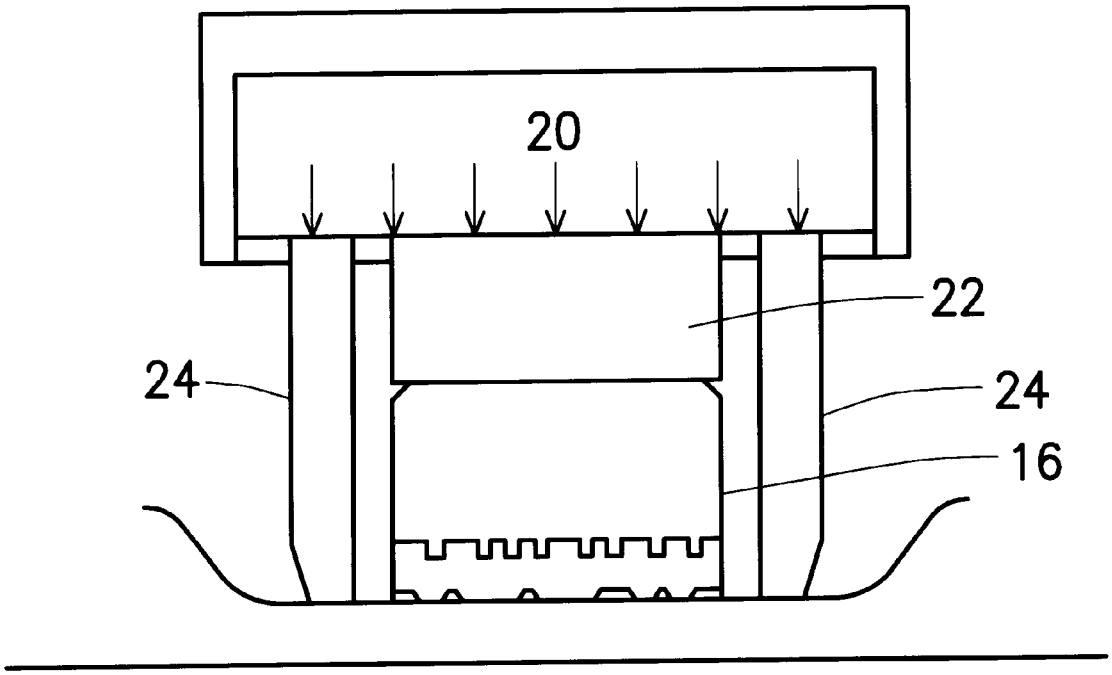
FIG. 1C (PRIOR ART)
FIG. 1C is a cross-sectional view showing a detailed inside structure of the polishing head used on the CMP machine of FIGS. 1A and 1B.

In accordance with the invention, an improved structure is provided for shaping the retainer ring used on the polishing head of a CMP machine. The retainer ring of the invention is intended to replace the conventional retainer ring used on the polishing table of the CMP machine shown in FIGS. 1A–1C. Two preferred embodiments of the invention will be disclosed in the following with reference to FIGS. 4A–4B and FIGS. 5A–5B respectively.

First Preferred Embodiment

Figure 4A:
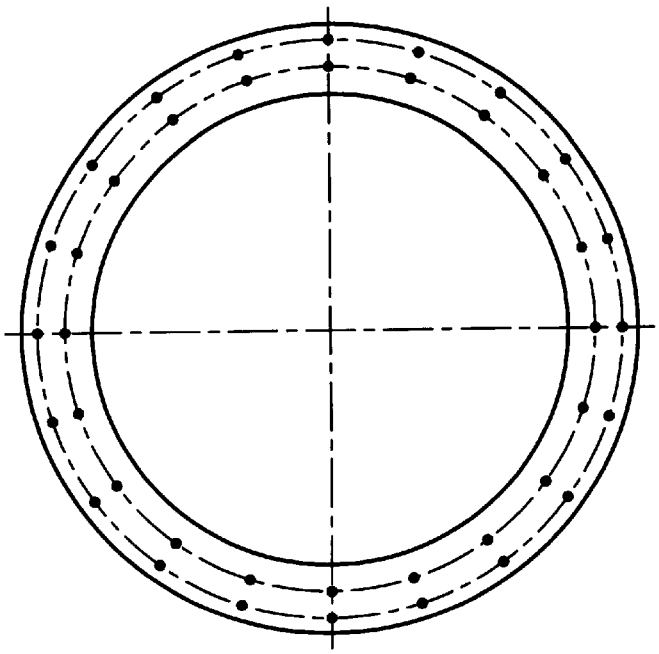
FIG. 4A is a schematic top view of a first preferred embodiment of the retainer ring according to the invention.
Figure 4B:
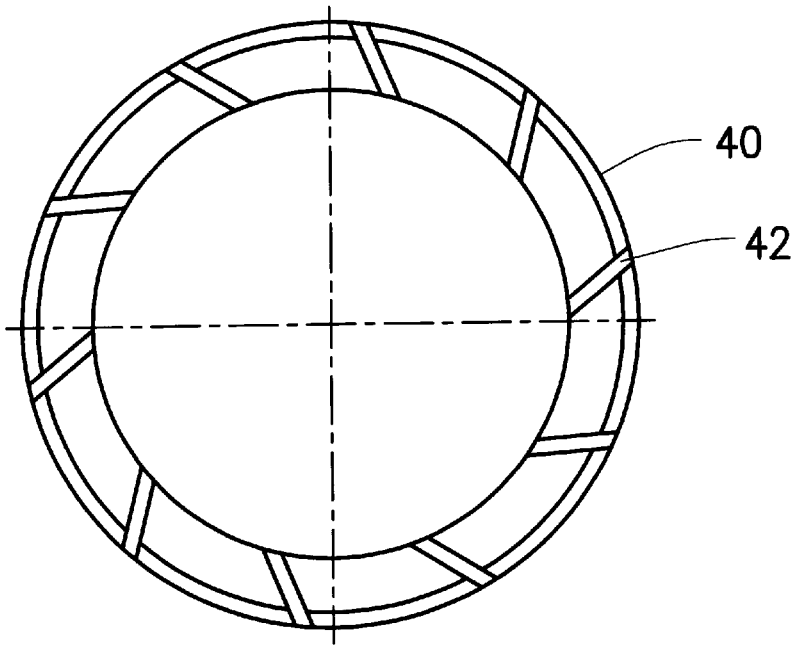
FIG. 4B is a schematic bottom view of the retainer ring of FIG. 4A.

FIG. 4A is a schematic top view of the first preferred embodiment of the retainer ring according to the invention which is designated by the reference numeral 40; and FIG. 4B is a schematic bottom view of same. In practice, for example, the retainer ring 40 of this embodiment is formed with an inner radius of 4 in. (inch) to 12 in. which is used to retain a semiconductor wafer (not shown) therein during the CMP process, and with the outer radius 6 to 14 inches. As shown in FIG. 4B, the retainer ring 40 is formed with a plurality of straight grooves 42 (in the case of FIG. 4B, for example, ten straight grooves are formed) which are spaced at substantially equal angular intervals around the retainer ring 40. Each of these straight grooves 42 is oriented at an angle with respect to the radius in such a manner that its outer end leads its inner end in angular position in reference to the spinning direction of the retainer ring 40. This allows the straight grooves 42 to be oriented in an acute angle of attack against the slurry on the outside of the retainer ring 40, thus capable of drawing the slurry therethrough into the inside of the retainer ring 40 when the retainer ring 40 is spinning at a high speed. In the case of FIG. 4B, for example, the orientation of the straight grooves 42 shows that the retainer ring 40 is to be spinning in the counterclockwise direction. In practice, for example, these straight grooves 42 are each formed with a width of 0.05~0.3 mm (millimeter) and a depth of 2~4 mm. The equally spaced manner of arrangement of the straight grooves 42 can cause the slurry to be drawn into the inside of the retainer ring 40 from all radial directions, thus allowing the slurry to be spread uniformly over the wafer (not shown) held on the inside of the retainer ring 40.

Figure 2A:
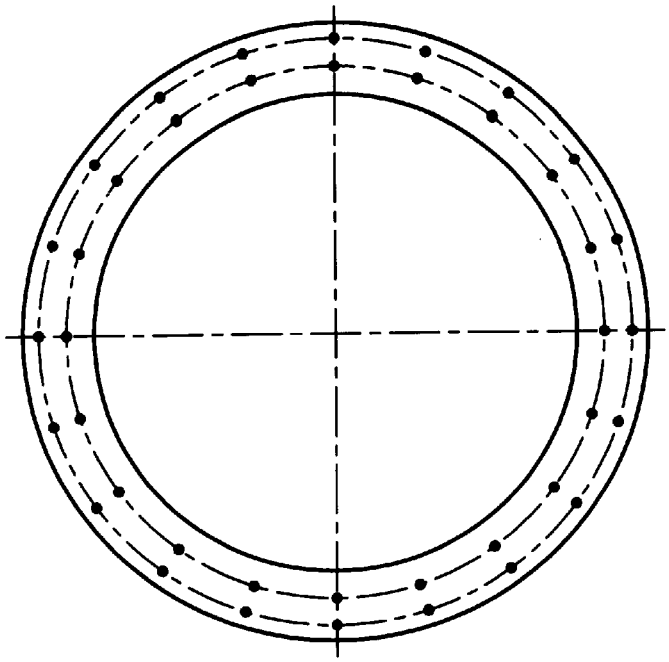
FIG. 2A (PRIOR ART)
FIG. 2A is a schematic top view of a conventional retainer ring used on the polishing head of FIG. 1C.
Figure 2B:
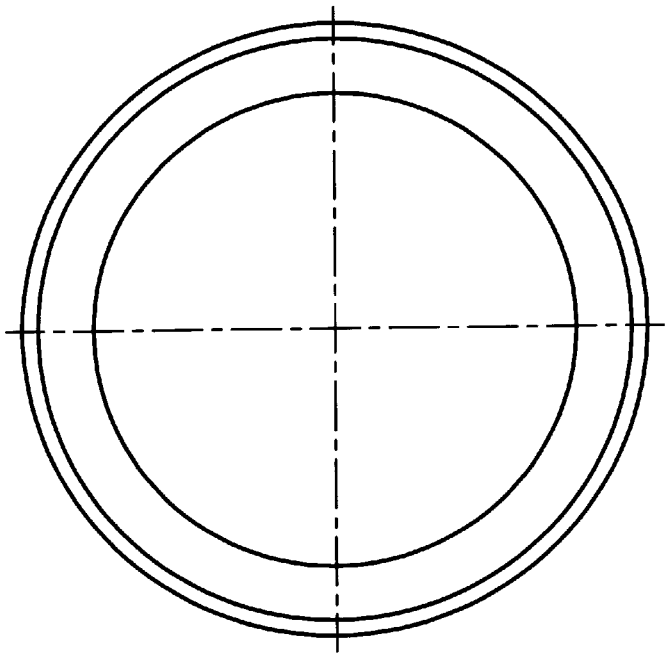
FIG. 2B (PRIOR ART)
FIG. 2B is a schematic bottom view of the conventional retainer ring of FIG. 2A.
Figure 3:
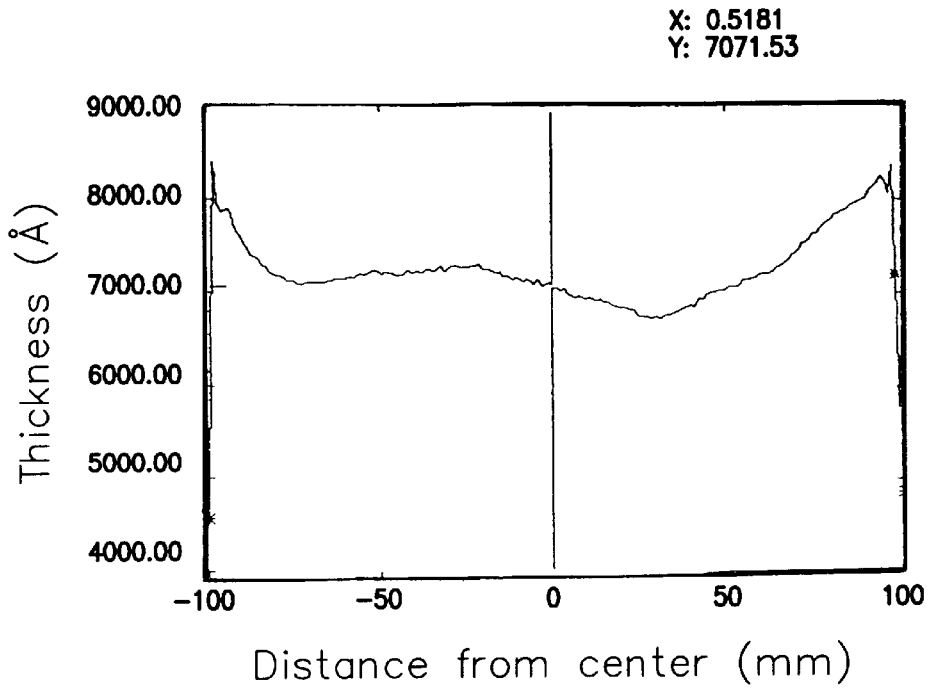
FIG. 3 (PRIOR ART)
FIG. 3 is a graph, showing the resultant flatness of the semiconductor wafer after undergoing a CMP process using the conventional retainer ring of FIGS. 2A–2B.
Figure 6:
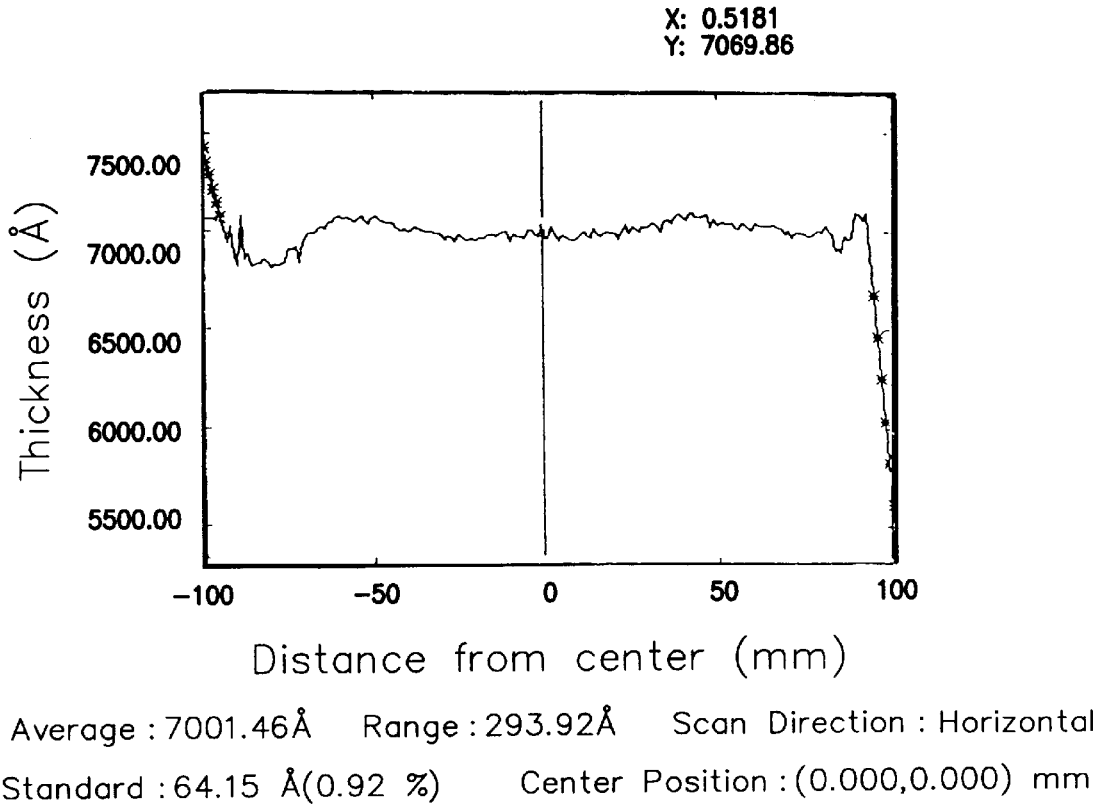
FIG. 6 is a graph, showing the resultant flatness of the semiconductor wafer after undergoing a CMP process using the retainer ring of FIGS. 4A–4B.
Figure 7:
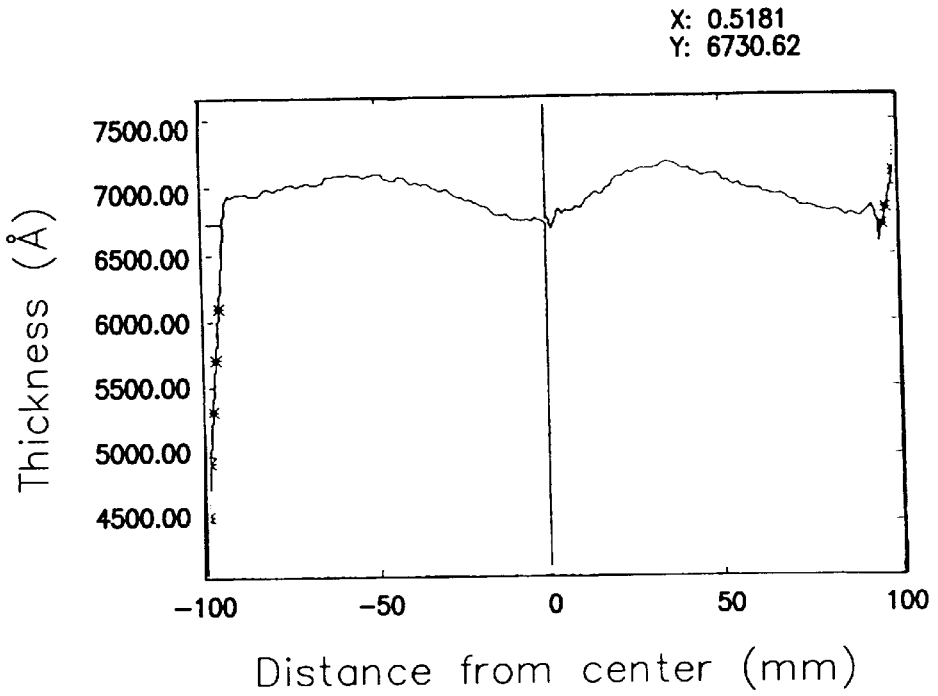
FIG. 7 is a graph, showing the resultant flatness of the semiconductor wafer after undergoing a CMP process using the retainer ring of FIGS. 4A–4B.

The resultant flatness of a wafer after undergoing a CMP process using the retainer ring of FIGS. 4A–4B is shown in FIG. 6 and FIG. 7. The flatness is measured in terms of the thickness values along a straight line passing through the center of the wafer. From the graphs of FIG. 6 and FIG. 7, it can be seen that the flatness of the wafer samples is significantly better than the flatness of the wafer shown in FIG. 3 achieved by using the prior art retainer ring of FIGS. 2A–2B. The standard deviation of thickness is 0.92% in the case of FIG. 6 and 1.38% in the case of FIG. 7, which are both significantly better than the standard deviation of 5.06% in the case of FIG. 3. Further, as shown in FIG. 7, since the edge portions of the wafer that are proximate to the inner ends of the straight grooves 42 would receive the greatest amount of slurry than other portions of the wafer, the thickness there is significantly less than that of other portions of the wafer.

Second Preferred Embodiment

Figure 5A:
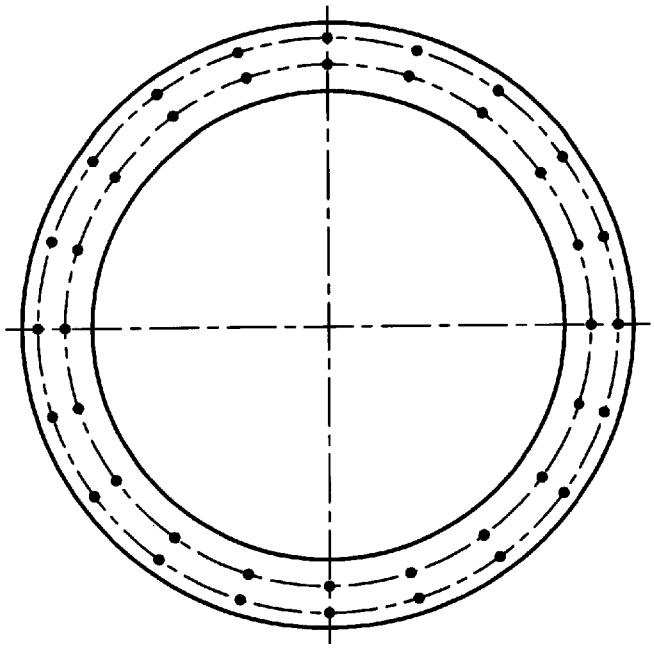
FIG. 5A is a schematic top view of a second preferred embodiment of the retainer ring according to the invention.
Figure 5B:
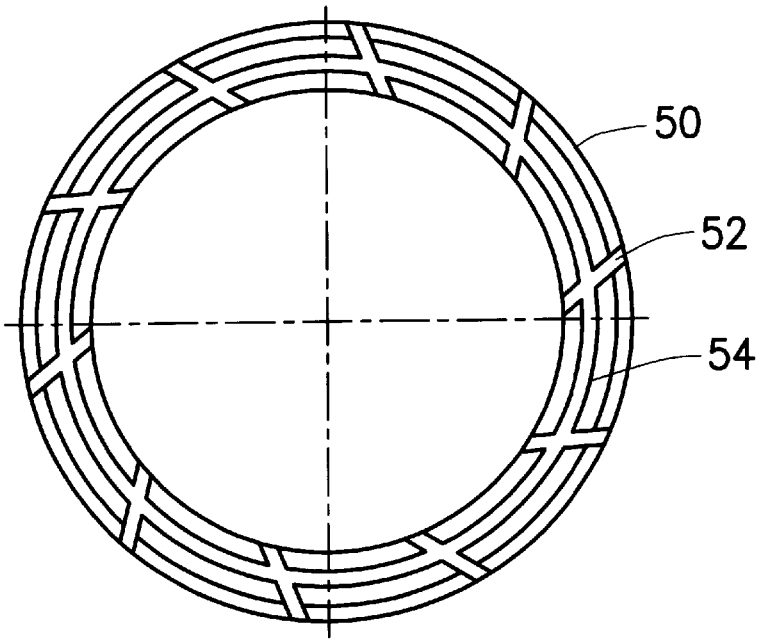
FIG. 5B is a schematic bottom view of the retainer ring of FIG. 5A.

FIG. 5A is a schematic top view of the second preferred embodiment of the retainer ring according to the invention which is designated by the reference numeral 50; and FIG. 5B is a schematic bottom view of same.

As shown in FIG. 5B, the retainer ring 50 of this embodiment is partly identical to the previous embodiment in that this embodiment is also formed with a plurality of straight grooves 52 (for example, ten straight grooves) which are spaced at substantially equal intervals around the retainer ring 50. Each of these straight grooves 52 is oriented in a similar manner as the previous embodiment and formed similarly with a width of 0.1 mm and a depth of 2~4 mm. This embodiment differs from the previous one in that at least one circular groove 54 is formed between the outer side and inner side of the retainer ring 50, intercrossing all of the straight grooves 52. This allows the slurry being drawn in through the straight grooves 52 to be partly buffered by and flow into the circular groove 54, thus allowing those edge portions of the wafer that are proximate to the inner ends of the straight grooves 52 to receive a buffered flow of slurry, allowing the polished effect there would not be too much different from other portions of the wafer. In practice, for example, the circular groove 54 is dimensioned in a similar manner as the straight grooves 52, i.e., with a width of 0.05~0.3 mm and a depth of 2~4 mm.

The invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded the broadest interpretation so as to encompass all such modifications and similar arrangements.

What is claimed is:

1. A retainer ring for use on a polishing machine having a polishing table, a polishing pad layered on said polishing table, a polishing head for holding a semiconductor wafer retained in a fixed position by said retainer ring, and means for applying a mass of slurry to the wafer, said retainer ring comprising:

a plurality of straight grooves spaced at substantially equal angular intervals around said retainer ring; and at least one circular groove intercrossing said plurality of straight grooves, each of said plurality straight grooves being radially inclined in such a manner so as to form an acute angle of attack against the slurry on the outside of said retainer ring when said retainer ring spins.

2. The retainer ring of claim 1, which is formed with an inner radius of 4 inches and an outer radius of 12 inches.

3. The retainer ring of claim 1, wherein said straight grooves are formed in a number of 10.

4. The retainer ring of claim 1, wherein said straight grooves are each formed with a width of 0.1 mm and a depth of 3 mm.

5. The retainer ring of claim 1, wherein said circular groove is formed between the outer side and inner side of said retainer ring.

6. The retainer ring of claim 1, wherein said circular groove is formed with a width of 0.05~0.3 mm and a depth of 2~4 mm.

* * * * *